United States Patent [19]

Nakae et al.

[11] 4,292,832

[45] Oct. 6, 1981

[54] METHOD OF PRODUCING VIBRATION ATTENUATING METALLIC MATERIAL

[75] Inventors: Hideo Nakae, Kashiwa; Toshinori Ozaki; Takashi Shimaguchi, both of Minorimachi; Syogo Morimoto, Matsudo, all of Japan

[73] Assignee: Hitachi, Ltd., Tokyo, Japan

[21] Appl. No.: 88,142

[22] Filed: Oct. 25, 1979

[30] Foreign Application Priority Data

Oct. 27, 1978 [JP] Japan ..... 53-131652

[51] Int. Cl.[3] ..... B21B 1/38

[52] U.S. Cl. ..... 72/365; 72/379; 248/636

[58] Field of Search ..... 72/365, 379; 248/636; 113/116 Y

[56] References Cited

U.S. PATENT DOCUMENTS 4,203,195 5/1980 Nakae ..... 248/636 X

*Primary Examiner*—Gary L. Smith

*Attorney, Agent, or Firm*—Craig and Antonelli

[57] ABSTRACT

A method of producing a vibration attenuating material having the steps of forming a multiplicity of grooves in the surface of a ductile raw material and subjecting the raw material to a drawing or rolling work to form a multiplicity of minute friction interfaces in the surface region of the vibration attenuating material. An improved vibration attenuating performance is ensured by a suitable selection of numerical values of factors such as relationship between the maximum depth of the friction interface and the thickness of the vibration attenuating material, pitch of the friction interfaces and so forth.

9 Claims, 20 Drawing Figures

($\theta_1, \theta_2 > 90°$)

($\theta_1, \theta_2 \approx 90°$)

($\theta_1, \theta_2 < 90°$)

($\theta_1, \theta_2 > 90°$)

( x 37.5 )

METHOD OF PRODUCING VIBRATION ATTENUATING METALLIC MATERIAL

BACKGROUND OF THE INVENTION

The present invention relates to a method of producing a vibration or noise attenuating metallic material suitable for use in acoustic instruments and various industrial equipments which require a suppression of vibration and noise.

Hitherto, it has been proposed to form a multiplicity of minute cracks in the surface of a metallic material by effecting an intergranular corrosion, and to use this metallic material as a vibration attenuating material. However, in some cases, it is not possible to obtain the desired state of minute cracks by the intergranular corrosion. This conventional method, therefore, is applicable only to limited materials.

As a countermeasure, there has been proposed a method of producing a vibration attenuating metallic material which does not rely upon the intergranular corrosion. More specifically, this method makes use of a drawing or rolling work. A multiplicity of grooves are mechanically formed in the surface of the material. Thereafter, the material is subjected to a drawing or rolling work so that a multiplicity of minute cracks in the desired state are formed in the surface of the material. This method relying upon the drawing or rolling work eliminates the problem of the limitation with respect to the material almost completely.

OBJECT OF THE INVENTION

It is an object of the invention to provide a method of producing a vibration attenuating material in which a multiplicity of minute cracks are formed in the surface of a ductile metallic material by effecting a drawing or rolling work on the metal after mechanically forming a multiplicity of grooves in that metal, capable of further improving the vibration attenuation performance.

SUMMARY OF THE INVENTION

According to the invention, there is provided a method of producing a vibration attenuating material in which a multiplicity of minute friction interfaces are formed in the surface layer of a ductile material by subjecting the material to a drawing or rolling work after mechanically forming a multiplicity of grooves in the surface of that material, wherein the friction interfaces are constituted by components vertical to the surface of the material and components inclined to the surface of the material or, alterntively, solely by the inclined components.

The following relation should exist between the maximum depth d of the friction interface from the surface of the material and the thickness $d_o$ of the material.

$$0.1d_o < d < 0.7d_o$$

When the friction interfaces are formed on both sides of the material, the following relation should exist between the respective maximum depths $d_1$, $d_2$ of the friction interface and the thickness $d_o$ of the material.

$$0.1d_o < d_1 + d_2 < 0.7d_o$$

The gap between vertical components of the friction interface is selected suitably to fall within a region smaller than 200 $\mu$m. The pitch of the interface, i.e. the distance between a friction interface and the adjacent friction interface is selected to be not greater than 12 mm or not greater than a value which is 6 (six) times as large as the material thickness.

Also, the arrangement is such that the adjacent friction interfaces have different depths of the inclined component and component parallel to the material surface from the latter.

According to another aspect of the invention, there is provided a method of producing a vibration attenuating material in which members hade of a ductile material, each having a multiplicity of holes or grooves, are superposed and then subjected to a drawing or rolling work so as to be unitarized with each other to become a vibration attenuating material having a multiplicity of minute friction interface in its surface region.

BRIEF DESCRIPTION OF THE DRAWINGS

FIG. 1(*b*) is a sectional view of the material shown in FIG. 1(*a*) in the state after a rolling;

FIG. 1(*c*) is a microscopic photograph of a section of a vibration attenuating material at a magnification of 37.5;

DESCRIPTION OF THE PREFERRED EMBODIMENTS

Hereinafter, preferred embodiments of the invention will be described in detail with reference to the axxompanying drawings.

Figure 1A:
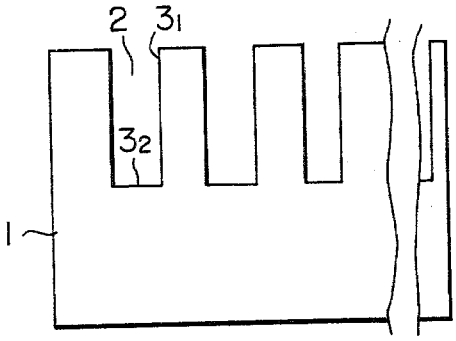
FIG. 1(*a*) is a sectional view of a raw material having a number of grooves formed therein.
Figure 1B:
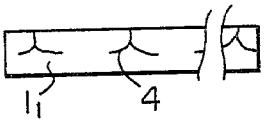
Figure 2A:
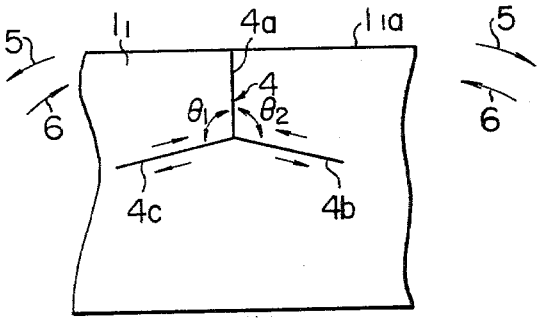
FIGS. 2(*a*) to 2(*d*) are sectional views illustrating the friction interface of the vibration attenuating material.
Figure 2B:
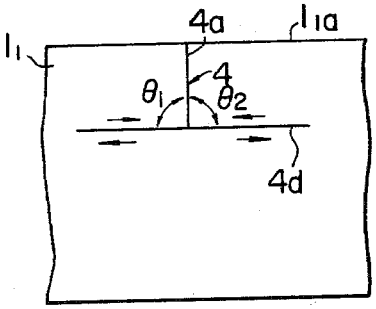
Figure 2C:
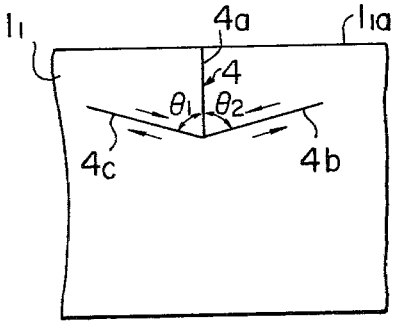
Figure 2D:
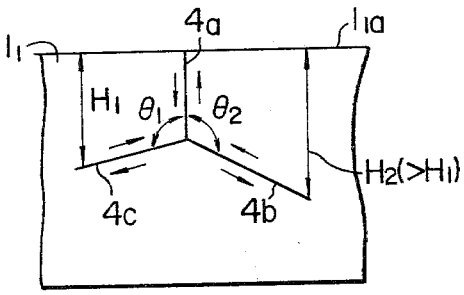
Figure 1C:
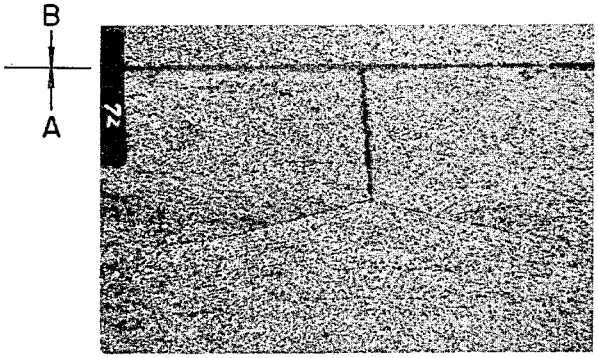

Referring first to FIG. 1(*a*), a raw material 1, in which a multiplicity of grooves have been formed beforehand, is subjected to a rolling. As a result of the rolling, the side walls $3_1$ and the bottom wall $3_2$ of each groove are deformed so that the material after the rolling exhibit a cross-section as shown in FIG. 1(*b*). A vibration attenuating material $1_1$ having an inversed Y or an inversed T-shaped friction interface is produced by this process. FIG. 1(*c*) shows a microscopic photograph (magnification 37.5) of a section of a vibration attenuating material having an inversed Y-shaped friction interface and made of an ordinary structural steel SS41 (C:0.25%, Si:0.6%, Mn:0.7%, P:0.035%, S:0.03% and remainder Fe). In FIG. 1(*c*), the portion A is the speciment of the attenuating material, while the portion B is an auxiliary member jointed for polishing the specimen.

Figure 3A:
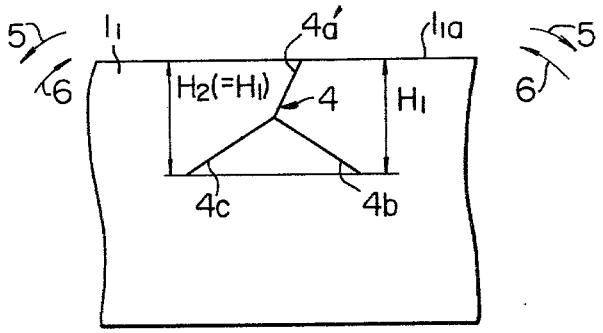
FIGS. 3(*a*) to 3(*c*) are also sectional views illustrating the friction interface of the vibration attenuating material.
Figure 3B:
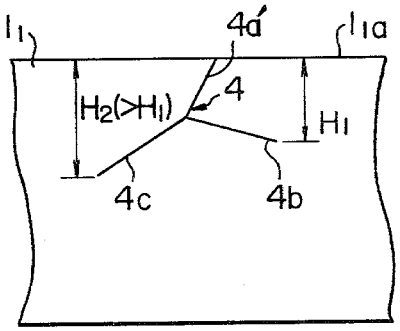
Figure 3C:
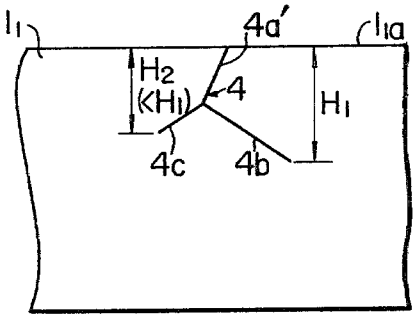
Figure 4A:
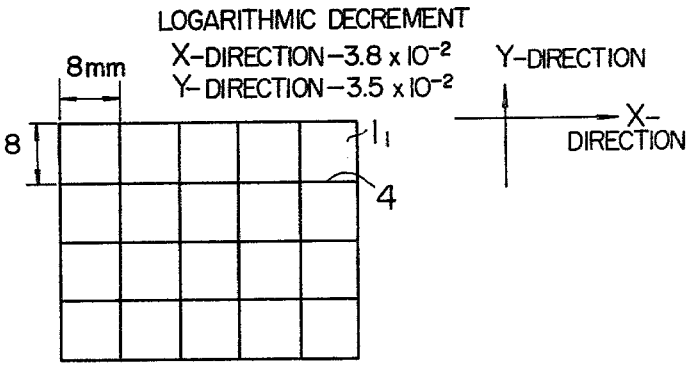
FIGS. 4(*a*) to 4(*d*) are plan views illustrating the friction interface in the surface region of the vibration attenuating material.
Figure 4B:
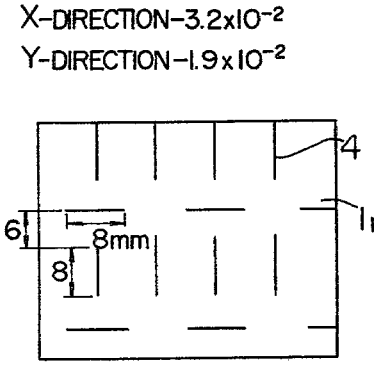
Figure 4C:
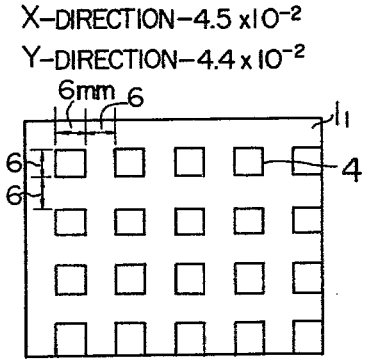
Figure 4D:
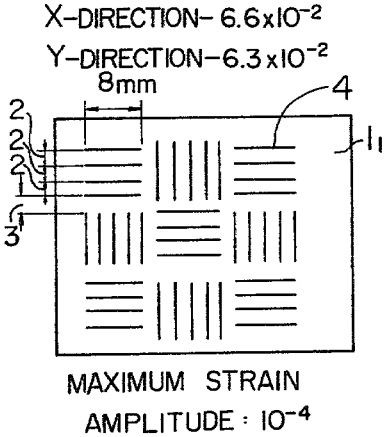

As shown in FIGS. 2(*a*) to 2(*d*), the friction interface 4 is composed of a vertical component 4*a* vertical to the surface $\mathbf{1}_{1a}$ of the attenuating material $\mathbf{1}_1$ and inclined components 4*b*, 4*c* inclined to the surface $\mathbf{1}_{1a}$ or parallel component 4*d* parallel to the surface $\mathbf{1}_{1a}$. Alternatively, the friction interface 4 is composed solely of inclined components 4*a*', 4*b*' and 4*c*', as shown in FIGS. 3(*a*) to 3(*c*).

This friction interface greatly contributes to the attenuation of vibration as will be understood from the following description.

When a strain is given by a vibration to a material having internal interfaces (cracks), an attenuation of the vibration takes place possibly owing to a visco-elasticity at the portion of large strain caused by the presence of the interface and also due to a mutual contact between both surfaces consituting the interface.

As a vibration is applied to a material $\mathbf{1}_1$ having an internal interface 4 to cause a bending strain in the direction of arrow 5 as shown in FIGS. 2(*a*) to 2(*c*), regions of high strain are formed near the ends of the vertical component 4*a*, inclined components 4*b*, 4*c* and parallel component 4*d*. The generation of high strain contributes greatly to the attenuation of the vibration effected by the visco-elasticity of the material itself, as compared with the case where no internal interface is formed.

On the other hand, when a bending stress is caused in the direction of arrow 6, the surfaces constituting the vertical component 4*a* of the interface are closely contacted by each other, so that the region defined by the surface $\mathbf{1}_{1a}$ of the material, vertical component 4*a*, and inclined components 4*b*, 4*c* of the the parallel component 4*d* constitutes a so-called leaf spring which also contributes to the attenuation of the vibration. In case of FIG. 2(*c*), a leaf spring is formed also by a bending in the direction of arrow 5 to contribute to the attenuation of the vibration.

Also, in FIG. 2(*a*) as a bending in the direction of the arrow 5, a relative slip is caused between the upper surface and the lower surface of the inclined components 4*b*, 4*c* of the interface to effect an attenuation due to friction. This attenuation by the friction is caused also in case of FIGS. 2(*b*) and 2(*c*).

Further, in case of FIGS. 2(*a*) to 2(*c*), the surface constituting the vertical component 4*a* are only moved away from each other or together in close contact with each other, unless minute roughness exist on the surfaces of this component, so that no effective attenuation takes place. The same phenomenon takes place also in response to the bending in the direction of the arrow 6.

However, in case of FIG. 2(*d*), the portion defined by the vertical component 4*a* and the inclined component 4*b* and the portion defined by the surface $\mathbf{1}_{1a}$, vertical component 4*a* and inclined component 4*c* have different values of rigidity or stiffness to exhibit different amounts of deformation. As a result, a slip is caused between the surfaces constituting the vertical component 4*a* to further attenuate the vibration effectively.

FIGS. 3(*a*) to 3(*c*) show a vibration attenuating material in which the interface 4 is constituted by inclined components 4*a*', 4*b* and 4*c*. In case of FIG. 3(*b*), when the bending is imparted in the direction of arrow 5, no effective attenuation by the friction is caused because the portion defined by the surface $\mathbf{1}_{1a}$ and the inclined components 4*a*', 4*c* and the portion defined by the inclined components 4*a*', 4*b* exhibit such deformations as to increase the gap between the surfaces constituting the interface. In contrast to the above, the materials having internal interfaces as shown in FIGS. 3(*a*) and 3(*c*) can provide a strong vibration attenuating effect.

The present invention is to selectively use the above explained patterns of the interface.

FIG. 4 shows various plane patterns of materials $\mathbf{1}_1$ having friction interfaces 4 formed therein. More specifically, FIG. 4(*a*) shows an arrangement in which the friction interfaces are disposed in a crossing manner, FIG. 4(*b*) shows an arrangement in which the friction interfaces are formed in a crossing linear manner, FIG. 4(*c*) shows a loop-like arrangement of the friction interfaces and FIG. 4(*b*) shows an arrangement in which the friction interfaces are disposed in the form of a plurality of crossing groups each of which consisting of a plurality of parallel friction interfaces.

It has been confirmed, as a result of experiment, that the arrangements as shown in FIGS. 4(*a*) to 4(*d*) provide no substantial difference of logarithmic decrement between X and Y directions.

Table 1 shows the sizes of a material used in the experiment, i.e. a raw material (SS41) which is ductile, as well as the sizes of the materials after the work.

Figure 5:
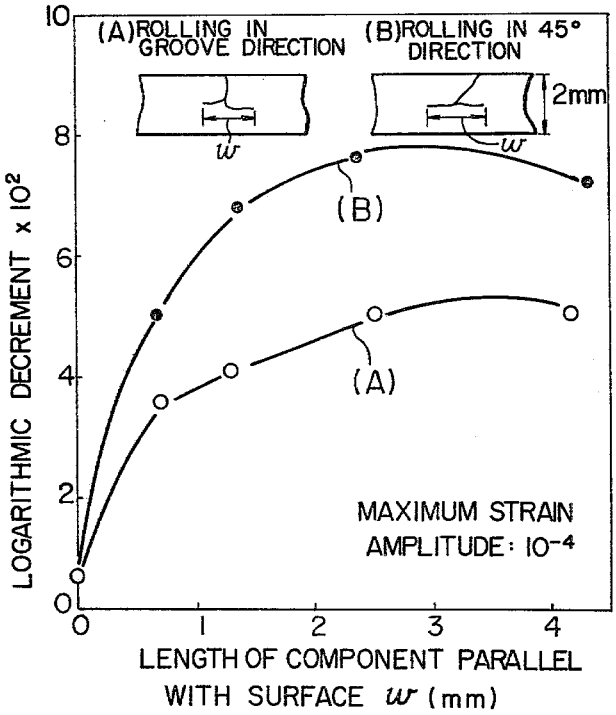
FIG. 5 is a chart showing the relationship between the logarithmic decrement and the length of component of the friction interface parallel to the surface of the material.

Raw materials of Nos. 1 to 5 of the table were rolled in the direction of the groove and in the direction inclined at 45° to the direction of the groove to a final plate thickness of 2 mm. From each material, a speciment of 20×145×2 mm was cut out in the direction perpendicular to the direction of rolling. The damping or attenuating capacity of each speciment was measured by a free-free lateral vibration method wherein a specimen is placed in a horizontal position and is supported at two points, each point being the same distance from an adjacent free end and thereafter the specimen is vibrated and the damping characteristics of the specimen are measured, the result of which is shown in FIG. 5.

From this Figure, it will be apparent that the attenuation capacity is increased as the length of the parallel component of the friction interface becomes larger. It is also clear that the specimen rolled in 45° direction shows a higher attenuation capacity than the specimen rolled in the direction of the groove. In other words, for obtaining an effective attenuation of the vibration, it is a better policy to incline the vertical component of the interface.

From this point of view, according to the invention, the direction of the friction interface is not limited to the vertical direction but to include parallel or inclined direction.

TABLE 1

| | raw material size | | | | size after work | | |
|---|---|---|---|---|---|---|---|
| No. | W | D | $D_o$ | P | $d_o$ | d | remarks |
| 1 | 0 | 0 | 12 | — | 2.0 | 0 | |
| 2 | 0.5 | 6 | " | 8 | " | 1.00 | w = 0.7 |
| 3 | 1 | 0.5 | " | " | " | 0.95 | w = 1.3 |
| 4 | 2 | 7 | " | " | " | 0.93 | w = 2.5 |
| 5 | 4 | 8 | " | " | " | 0.91 | w = 4.2 |
| 6 | 2.0 | 9.6 | 12 | 5.0 | " | 1.36 | w = 2.3 |
| 7 | " | 7.5 | " | " | " | 1.0 | w = 2.2 |
| 8 | " | 6.3 | " | " | " | 0.8 | w = 2.1 |
| 9 | " | 5.5 | " | " | " | 0.66 | w = 2.0 |
| 10 | " | 4.3 | " | " | " | 0.50 | w = 2.0 |
| 11 | " | 3.5 | " | " | " | 0.40 | w = 2.0 |

TABLE 1-continued

| No. | raw material size W | D | $D_o$ | P | size after work $d_o$ | d | remarks |
|---|---|---|---|---|---|---|---|
| 12 | " | *1 6.3 and 3.5 | " | 3.6 | " | 0.8 and 0.4 | — |
| 13 | " | *1 6.3 and 3.5 | " | 5.0 | " | 0.8 and 0.4 | — |
| 14 | " | *2 6.3 and 7.5 | " | 5.0 | " | 0.8 and 1.0 | — |
| 15 | " | *2 6.3 and 7.5 | " | 7.0 | " | 0.8 and 1.0 | — |
| 16 | " | 6.0 | 12 | 5.0 | " | 1.0 | C < 1 μm |
| 17 | " | 5.0 | 10 | " | " | " | C < 1 μm |
| 18 | " | 4.0 | 8 | " | " | " | C < 1 μm |
| 19 | " | 3.0 | 6 | " | " | " | C = 2 μm |
| 20 | " | 2.0 | 4 | " | " | " | C = 20 μm |
| 21 | " | 1.8 | 3.6 | " | " | " | C = 70 μm |
| 22 | " | 1.6 | 3.2 | " | " | " | C = 200 μm |
| 23 | " | 6.0 | 12 | 3.7 | " | 1.0 | |
| 24 | " | " | " | 7.0 | " | " | |
| 25 | " | " | " | 9.0 | " | " | |
| 26 | " | " | " | 11.0 | " | " | |
| 27 | " | " | " | 15.0 | " | " | |
| 28 | " | 6.3 | 12 | 5.0 | " | 8.0 | R = 0.3 |
| 29 | " | " | " | " | " | " | R = 0.1 |

*1 : 6.3 and 3.5 appears alternatingly
*2 : 6.3 and 7.5 appears alternatingly
W : width of groove in raw material
D : depth of groove in raw material
$D_o$ : thickness of raw material
P : pitch of grooves
$d_o$ : thickness after work
d : maximum depth of internal interface from surface of worked material
w : length of interface parallel to material surface
C : gap between interfaces normal to material surface after work
Note: The dimensions of the parameters in this Table are given in millimeters (mm.) unless otherwise stated.

Figure 6A:
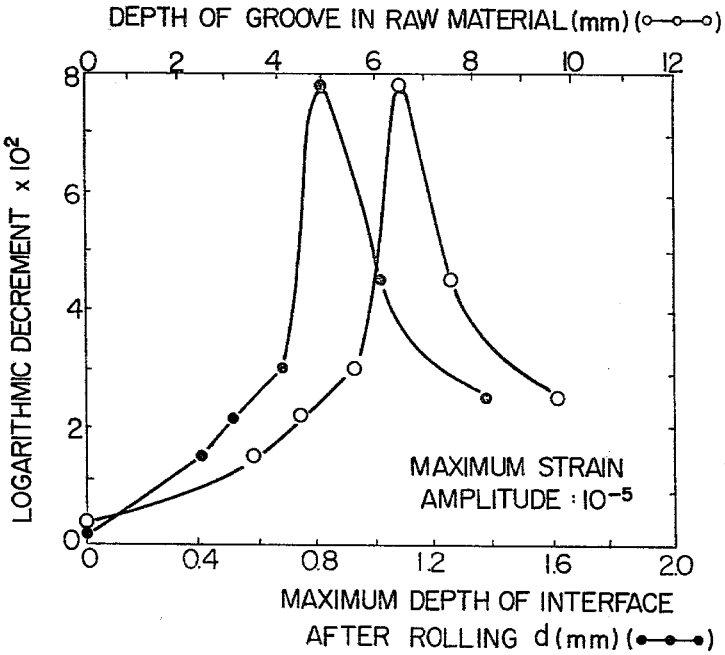
FIGS. 6(*a*) and 6(*b*) are charts showing the relationship between the maximum depth of the friction interface after rolling and the logarithmic decrement.
Figure 6B:
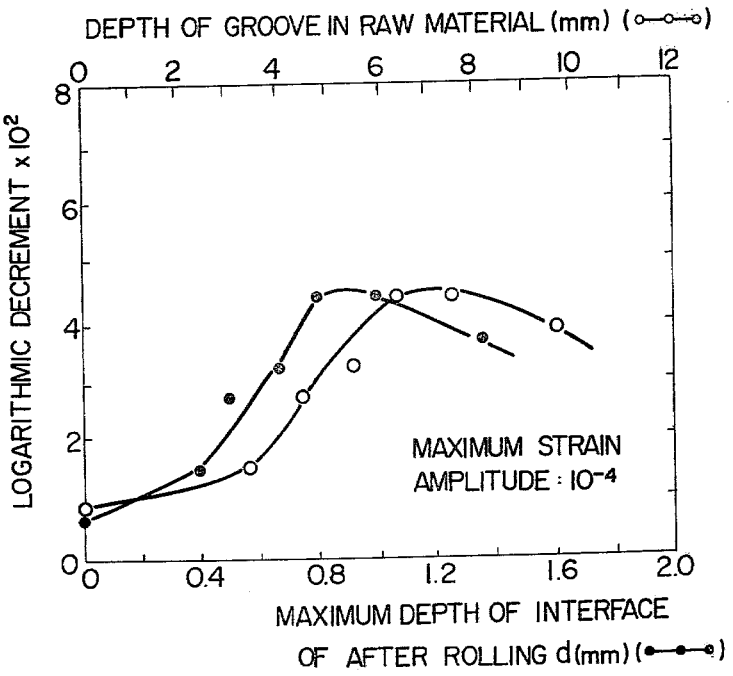

Subsequently, the raw materials of Nos. 6 to 11 were rolled in the direction of the groove to a final plate thickness of 2 mm, and specimen were cut out in the same manner as the aforementioned specimen. These specimens were subjected to a test of the same testing condition as before, the result of which is shown in FIGS. 6(*a*) and 6(*b*).

From these Figures, it will be seen that the attenuation capacity is affected by the value of the ration $d/d_o$ (material thickness). More specifically, the maximum value of the attenuation capacity is shown when the ration $d/d_o$ falls between 0.3 and 0.5. At the same tiem, it is found that the position of the maximum value is moved toward the larger side of $d/d_o$ as the maximum strain amplitude increases. Therefore, supposing here that a practical maximum strain amplitude is $10^{-6}$ to $10^{-3}$, the practical value of d is preferably between 0.1 and 0.7 $d_o$. Therefore, according to the invention, the position or depth d of the friction interface from the surface of the material is limited to fall within the range of between 0.1 and 0.7 $d_o$.

Thereafter, a test was conducted with the raw materials of Nos. 12 to 15 in the same testing condition. As a result of the test, it was found that the specimen of material Nos. 12 and 13 provide attenuating materials having alternating interfaces at positions of 0.4 and 0.8 mm from the material surface, respectively. The attenuation capacities of these materials were greater than that of the speciment obtained from the material No. 11 but smaller than that of the specimen formed from the material No. 9. In these specimens, however, the dependency on the maximum strain amplitude is not so remarkable. More specifically, a logarithmic decrement of $3.5\times10^{-2}$ to $4.0\times10^{-2}$ was obtained when the maximum strain amplitude is between $10^{-4}$ and $10^{-5}$.

On the other hand, specimen obtained from the material Nos. 14 and 15 showed substantially equal logarithmic decrement as those of the specimen formed from the material Nos. 7 and 8. Also, the dependency on the maximum strain amplitude was not so remarkable. More specifically, a logarithmic decrement falling between $4.5\times10^{-2}$ and $5.0\times10^{-2}$ was observed for the maximum strain amplitude falling between $10^{-4}$ and $10^{-5}$.

From this fact, it is derived that the material having friction interfaces of a plurality of depths from the obverse and reverse sides exhibit smaller dependency on the strain amplitude than the material having a single kind of friction interface.

In the described embodiment, it is less liable to occur that the surfaces constituting the parallel component of the friction interface unnecessarily approach each other. Therefore, even when cracking is caused at the end of the interfaces during rolling or use, these cracks are less likely to merge in each other, to ensure a stable production and high reliability in use.

Figure 7:
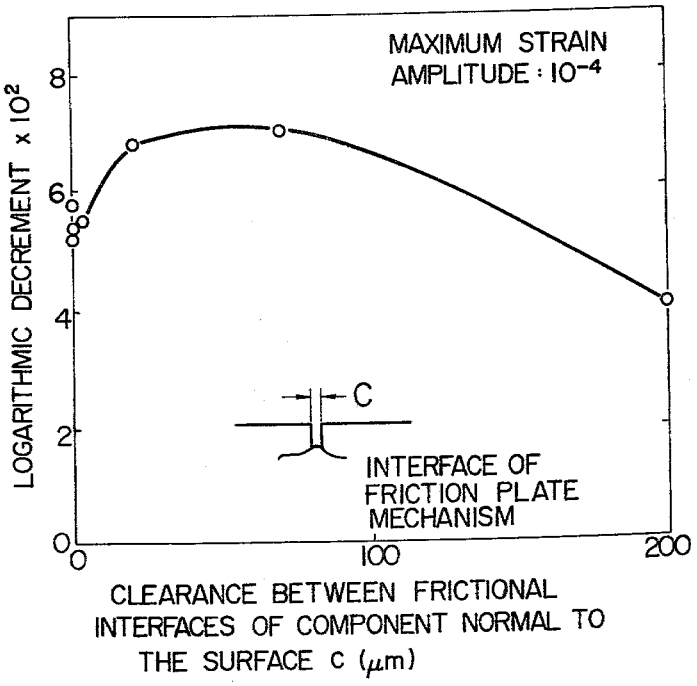
FIG. 7 is a chart showing how the gap between vertical friction interfaces affects the logarithmic decrement.

Then, a test was conducted with similar specimen obtained from the materials Nos. 16 to 22. In consequence, it was found that the specimen which has undergone a rolling of large reduction ratio, e.g. specimen obtained from the material Nos. 16 and 17, exhibit a large gap C of vertical component of the friction interface is not greater than 1 μm, while the specimen obtained from the material Nos. 21 and 22 exhibits a larger gap C ranging between 70 and 200 μm. The attenuation capacity is as shown in FIG. 7. It will be seen that the attenuation capacity is decreased when the value of the gap C exceeds 200 μm. This phenomenon can be attributed to the following reason. Namely, if the gap C takes a suitable value of about 50 μm, for example, the surfaces of the vertical component 4*a* shown in FIG. 2 do not collide with each other when a bending in the compressing direction is applied to the material, to permit the generation of friction in the interface components 4*b* and 4*c*.

On the other hand, the attenuation capacity is decreased as the gap C becomes excessively large. It is considered that this phenomenon is attributable to the fact that the effective length of the parallel component becomes small and theat the friction in the vertical component is nullified.

Figure 8:
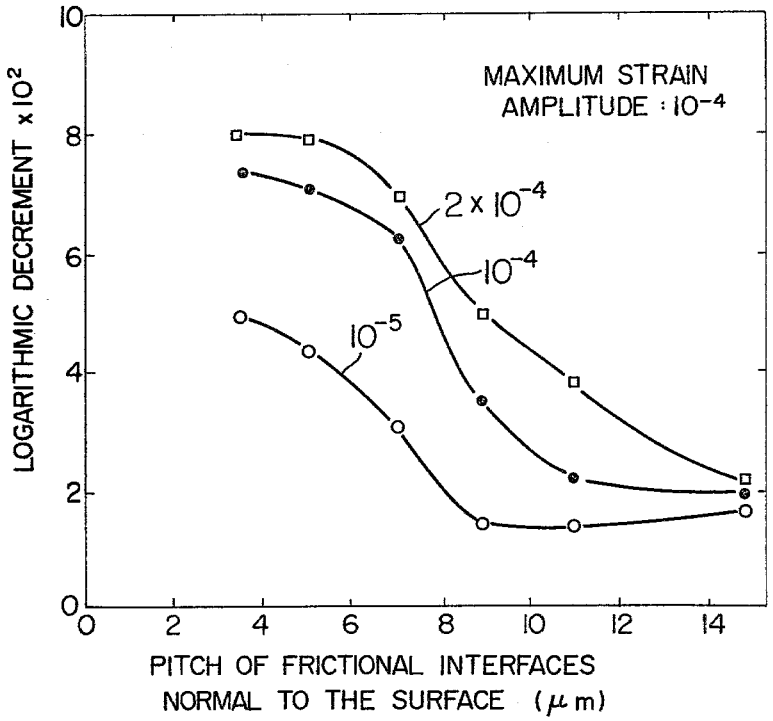
FIG. 8 is a chart showing how the pitch of vertical component of the friction interface affects the logarithmic decrement.

Further, a test was conducted with similar specimen obtained from the materials Nos. 23 to 27, the result of which is shown in FIG. 8. From the result of this test, it will be apparent that the attenuation capacity is increased as the pitch of the interface is reduced. The curve in FIG. 8 shows that there is a tendency that the increase of the attenuation capacity is saturated as the pitch of the interface comes down below a certain level.

It is considered that this phenomenon is attributable to the fact that, when an extremely large number of interfaces exist and arranged too densely, the contact force applied to each interface is lowered to decrease the frictional force generated in the interfaces caused by the vibration, to cause the saturation of increase of the attenuation capacity.

Therefore, the effective pitch in the material having a plate thickness of 2 mm falls within the range of 4 to 12 mm, preferably not greater than 9 mm, under the vibration of amplitude ranging between $2\times10^{-4}$ and $2\times10^{-5}$. The optimum value of the pitch changes depending on the thickness of the material, shape of the interface and other factors. With common knowledge of the elastic-plastic engineering and from the teaching of FIG. 8, it is estimated that the effective pitch is not greater than a value which is 6 times as large as the plate thickness, when the depth of the interface falls within the range of between 0.2 and $0.5d_o$. Therefore, in this embodiment, the pitch of the friction interface is limited to be not greater than 12 mm or not greater than a value which is 6 times as large as the plate thickness.

For producing a vibration attenuating material while fulfilling the above-mentioned requirement of the pitch, it is an effective measure to form grooves in the surface of the material in such a manner as to fulfill the above requirement for the pitch and, subsequently, to roll the material in the longitudinal direction of the grooves. In such a process, the increase of the pitch caused by the rolling is negligibly small. When rolling is made in the direction perpendicular to the groove or at an inclination to the latter, it is not possible to effectively suppress the increase of the pitch. It is, therefore, necessary to determine the pitch taking into consideration the shape which will be obtained after the rolling. To the contrary, a drawing work tends to cause a decrease of the pitch. It is, therefore, necessary to determine the original pitch taking this reduction of pitch into account.

The recesses (grooves) in the surface of the ductile material can advantageously be formed by a forming roll having projections or protrusions in its peripheral surface. Then, the rolling is effected by a roll having a smooth peripheral surface. This process permits the most efficient production of the vibration attenuating material.

Figure 9:
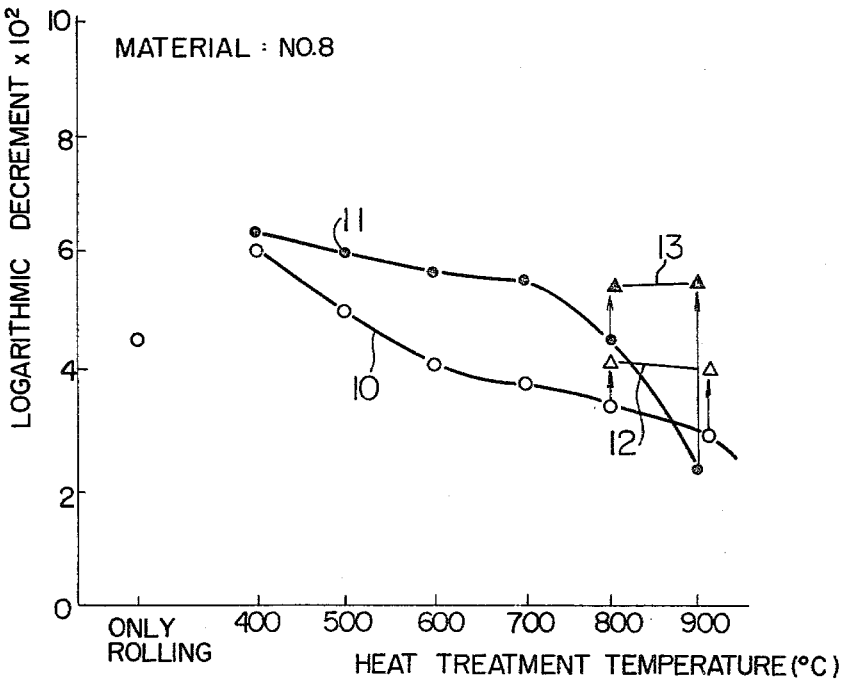
FIG. 9 is a chart showing the relationship between the heat treatment temperature and the logarithmic decrement.

The relationship between heat treatment and rolling conditions and the vibration attenuation characteristic was examined using the No. 8 material in the table, the result of which is shown in FIG. 9. As will be apparent from this Figure, the attenuation performance is gradually lowered and no abrupt reduction of the attenuation performance is observed, as shown by a curve 10, if the material is held at each temperature for 1 hour after the cold rolling. To the contrary, in case of the material processed by a warm rolling, the attenuation capacity is drastically lowered as the temperature exceeds 700° C., as will be seen from curve 11. Therefore, the heat treatment is reserved preferably at a temperature below 700° C.

An improvement in the attenuation capacity can be achieved as shown by straight lines 12, 13, if a one-pass cold rolling is effected subsequently to the above-mentioned heat treatment. It is to be noted also that a substantially equivalent effect is obtained by effecting a bending in such a manner as to convex the surface of the material, instead of the one-pass rolling. This improvement in the attenuation capacity is attributable to the fact that the parts of the surfaces constituting each interface, which have been partially welded to each other, are separated again from each other as a result of the cold work.

Generally, for an easier rolling of materials, it is preferred to effect an annealing at each time of the work. An excessive annealing, however, adversely affects the shape of the friction interface to incur not only the reduction of the attenuation capacity and the fatigue limit but also a heavy generation and attaching of oxide scale.

Next, a study was made on the shape of the bottom parts of the groove. In the materials Nos. 28 and 29 of Table 1, the radii R of corners of the bottom part were determined as shown in the Table. The attenuation capacities of these materials were measured after the rolling effected in the same manner as that described before. The logarithmic decrement of $1.5\times10^{-2}$ and $3\times10^{-2}$ were observed in the materials of Nos. 28 and 29, respectively, for the maximum strain amplitude of $10^{-4}$. A similar test conducted with the No. 7 material ($R<0.02$) exhibited a logarithmic decrement of $4.5\times10^{-2}$. The above stated fact can be understood also from the deformation or behaviour of the side walls and bottom wall of the groove during the rolling which is effected in the vertical direction. It will be understood that a smaller radius R provides higher effectiveness of the friction interface.

An Ni-Cr-Mo steel SNCM8 ($300\times250\times1.5$ mm, C:0.40%, Si:0.025%, Mn:0.75%, P:0.021%, S:0.013%, Ni:1.85%, Cr:0.82%, Mo:0.26% and remainder Fe) having 2 mm dia. holes at a density of 300 holes/$dm^2$ was superposed to a piece of sufficiently annealed pure aluminum ($300\times250\times5$ mm). Thesematerials are then subjected to a cold rolling. As a result, a rolled plate of 3 mm thick and with the aluminum filling the holes in the SNCM8 material was obtained. The aforementioned specimen was cut out from this plate, and a test was made with this specimen to examine the logarithmic decrement. This specimen showed a logarithmic decrement of $3.2\times10^{-2}$.Thus,it proved that this composite material has an attenuation capacity which is remarkably improved over those of the original aluminum and SNCM8 materials. It was also found that the resistance or strength against the separation of the aluminum and SNCM8 materials at the interface depends on the strength of aluminum.

In the described embodiment, it is possible to use waste materials such as punched steel plate or the like as the member having the holes or grooves. In such a case, the drawing and rolling works can easily be effected, and the troublesome work for forming the grooves or holes is completely eliminated.

The grooves in the raw material can easily and advantageously be formed by a roll having peripheral teeth, i.e. a roll in which a plurality of grooves are formed in axial or circumferential direction in the peripheral surface thereof.

For reducing the radius of curvature at corners of the groove bottom, and for facilitating the roll work, it is an advantageous and effective measure to adopt a multistage rolling or to effect the rolling of every other groove, employing a plurality of rolls.

As has been described, the present invention offers an improvement in the performance of vibration attenuating material over the conventional production method, by numerically grasping various factors such as relationship between the thickness of the material and the maximum depth of the friction interface formed in the material, pitch of the friction interface and so forth and selecting specific ranges of values of these numerical factors.

What is claimed is:

1. A method of producing a vibration attenuating material having a high vibration attenuating performance, said method having the steps of forming a multiplicity of grooves in the surface of a ductile raw material, and subjecting said raw material to a drawing or a rolling work thereby to form a multiplicity of fine friction interfaces in the surface region of said vibration attenuating material, wherein the improvement comprises that said vibration attenuating material is formed such that each of said friction interfaces is composed of a vertical component perpendicular to the surface of said vibration attenuating material and inclined components inclined to said surface of said vibration attenuating material.

2. A method of producing a vibration attenuating material as claimed in claim 1, wherein the maximum depth d of said friction interface from said surface of said vibration attenuating material and the thickness $d_o$ of said vibration attenuating material are so selected as to meet the following condition:

$$0.1d_o < d < 0.7d_o.$$

3. A method of producing a vibration attenuating material as claimed in claim 2, wherein the gap between surfaces constituting said vertical component of said friction interface is selected to fall within a range of below 200 μm.

4. A method of producing a vibration attenuating material as claimed in claim 2, wherein the pitch of said friction interfaces is selected to be not greater than 12 mm or not greater than a value which is six times as large as the thickness of said vibration attenuating material.

5. A method of producing a vibration attenuating material as claimed in claim 3, wherein said raw material is subjected to a heat treatment before or after said drawing or rolling work.

6. A method of producing a vibration attenuating material as claimed in claim 3, wherein the adjacent friction interfaces have different depths of said inclined component or parallel component from said surface of said vibration attenuating material.

7. A method of producing a vibration attenuating material having a high vibration attenuating performance, said method having the steps of forming a multiplicity of grooves in the surface of a ductile raw material and subjecting said raw material to a drawing or rolling work thereby to form a multiplicity of fine frictional interfaces in the surface region of said vibration attenuating material, wherein the improvement comprises that the maximum depths $d_1$, $d_2$ of said friction interfaces from the obverse and reverse surfaces of said vibration attenuating material and the thickness $d_o$ of said vibration attenuating material are so selected as to meet the following condition:

$$0.1d_o < d_1 + d_2 < d_o.$$

8. A method of producing a vibration attenuating material having a high vibration attenuating performance, comprising the steps of: preparing a ductile raw material; overlaying another material having grooves or holes in its surface on said raw material; and subjecting said raw material and said another material in superposed condition to a drawing or rolling work; thereby to unitarize said materials while forming a multiplicity of minute friction interfaces in the surface region of said unitarized material.

9. A method of producing a vibration attenuating material having a high vibration attenuating performance, said method having the steps of forming multiplicity of grooves in the surface of a ductile raw material and subjecting said raw material to a drawing or rolling work thereby to form a multiplicity of minute friction interfaces in the surface region of said vibration attenuating material, wherein the improvement comprises that each of said friction interfaces is composed solely of inclined components which are inclined to the surface of said vibration attenuating material.

* * * * *